United States Patent [19]

Ertl

[11] Patent Number: 4,559,646

[45] Date of Patent: Dec. 24, 1985

[54] WORK GLOVE

[75] Inventor: James L. Ertl, Appleton, Wis.

[73] Assignee: Zwicker Knitting Mills, Appleton, Wis.

[21] Appl. No.: 613,446

[22] Filed: May 24, 1984

Related U.S. Application Data

[63] Continuation-in-part of Ser. No. 534,160, Sep. 21, 1983, abandoned.

[51] Int. Cl.[4] ..... A41D 13/10

[52] U.S. Cl. ..... 2/16; 2/161 R; 2/169

[58] Field of Search ..... 2/159, 161 A, 161 R, 2/164, 160, 16, 20

[56] References Cited

U.S. PATENT DOCUMENTS

| | | | |
|---|---|---|---|
| 2,858,542 | 11/1958 | Ogg | 2/161 A |
| 2,907,047 | 10/1959 | Steinberg | 2/161 A |
| 4,146,935 | 4/1979 | Hinton | 2/161 A |
| 4,454,611 | 6/1984 | Tschirch et al. | 2/164 X |

FOREIGN PATENT DOCUMENTS

| | | | |
|---|---|---|---|
| 469818 | 12/1950 | Canada | 2/161 R |
| 1244221 | 12/1960 | France | 2/161 R |
| 1538699 | 7/1968 | France | 2/161 R |
| 8191 | of 1892 | United Kingdom | 2/164 |
| 885182 | 12/1961 | United Kingdom | 2/164 |

*Primary Examiner*—Werner H. Schroeder
*Assistant Examiner*—T. Graveline
*Attorney, Agent, or Firm*—Fred Wiviott

[57] ABSTRACT

A work glove comprises an outer shell having finger and thumb portions, a foam pad attached to the shell and covering the palm and the frontal areas of the thumb and finger portions thereof. The pad has a plurality of spaced apart holes and contours defining the finger and thumb joints and a fabric lining covering at least the inner surface of the foam pad.

15 Claims, 7 Drawing Figures

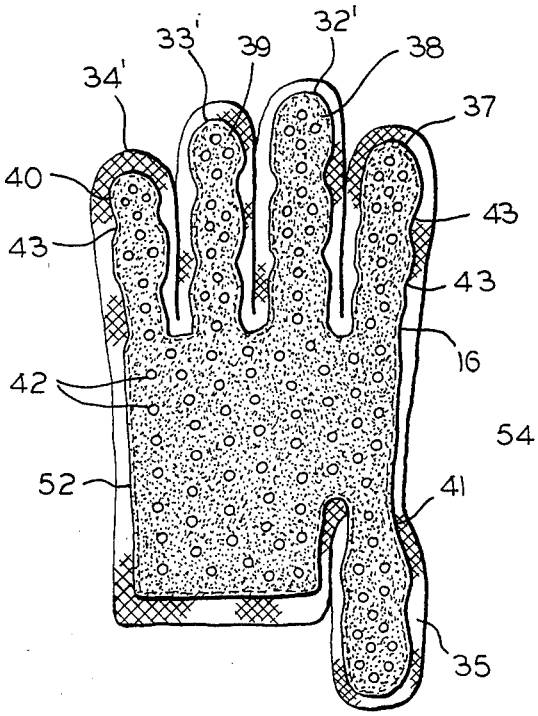
FIG.5
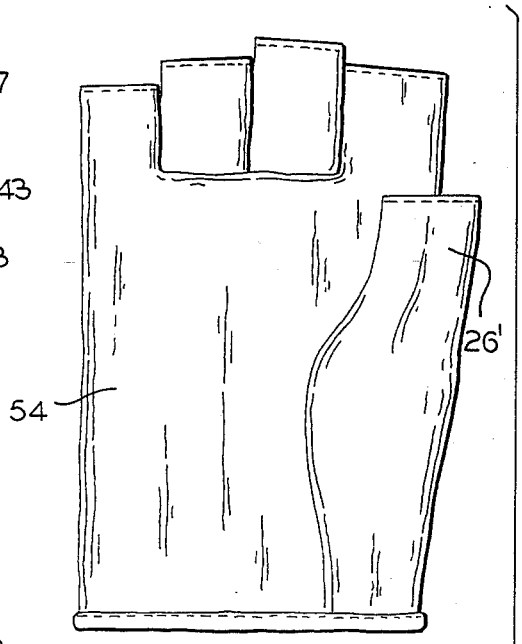
FIG. 7
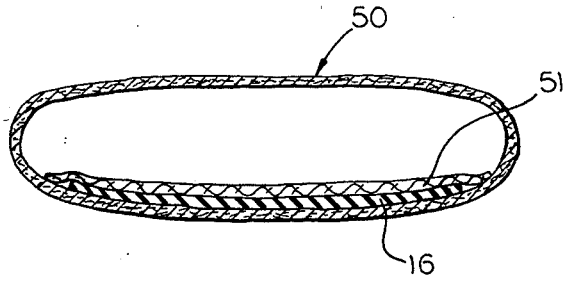
FIG.6
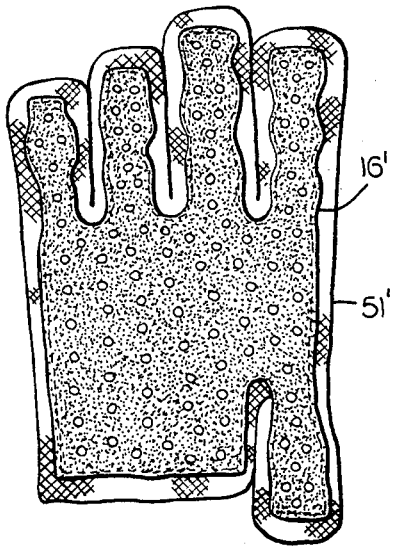

WORK GLOVE

CROSS REFERENCE TO RELATED APPLICATION

This application is a continuation-in-part of application Ser. No. 534,160, filed Sept. 21, 1983, now abandoned.

BACKGROUND OF THE INVENTION

This invention relates to gloves and more particularly to impact resistant work gloves.

The vibration and impacts which are characteristic of certain tools such as air hammers, chain saws and the like can be detrimental to the operator. Gloves capable of absorbing such shocks and vibrations would be very beneficial.

SUMMARY OF THE INVENTION

It is an object of the invention to provide a new improved work glove.

A further object of the invention is to provide a work glove which absorbs shocks and vibrations from tools with which it is in contact.

These and other objects and advantages of the present invention will become more apparent from the detailed description thereof taken with the accompanied drawings.

In general terms the invention comprises a work glove having an outer shell which includes portions defining a palm, a back, fingers and a thumb. A lining is disposed within the shell and has palm, finger, thumb and back portions disposed adjacent the corresponding portions of the shell. A foam pad is disposed between the lining and the shell and encompasses a substantial portion of the palm and the frontal areas of the thumb and finger portions of the shell.

BRIEF DESCRIPTION OF THE DRAWINGS

FIG. 5 shows a portion of a further embodiment of the invention;

FIG. 6 is a cross-sectional view of the alternate embodiment of the invention in FIG. 5; and FIG. 7 is an exploded perspective view of yet another alternate embodiment of the invention.

DETAILED DESCRIPTION OF THE PREFERRED EMBODIMENT

Figure 1:
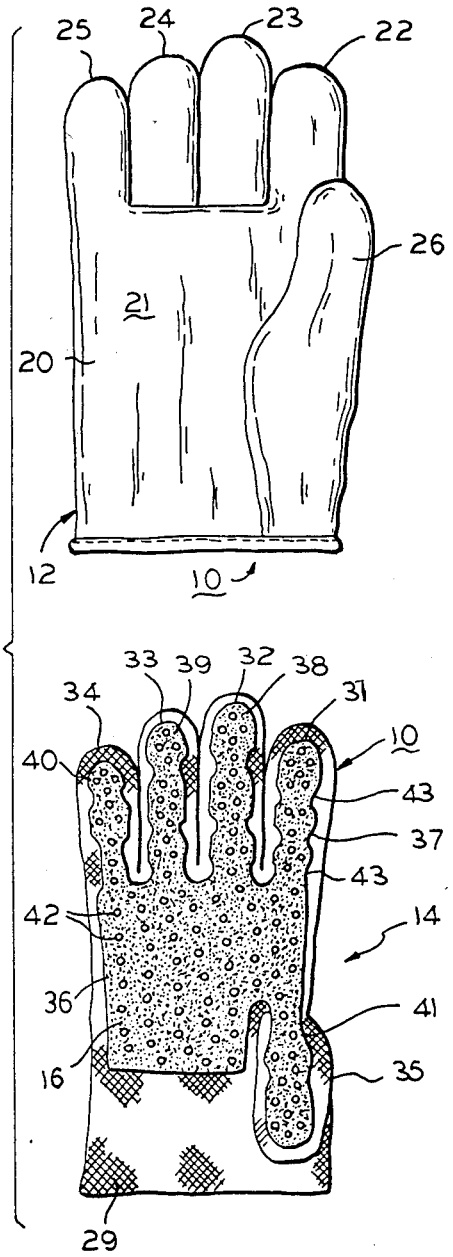
FIG. 1 is an exploded front view showing the shell and lining of a work glove in accordance with a preferred embodiment of the invention.
Figure 2:
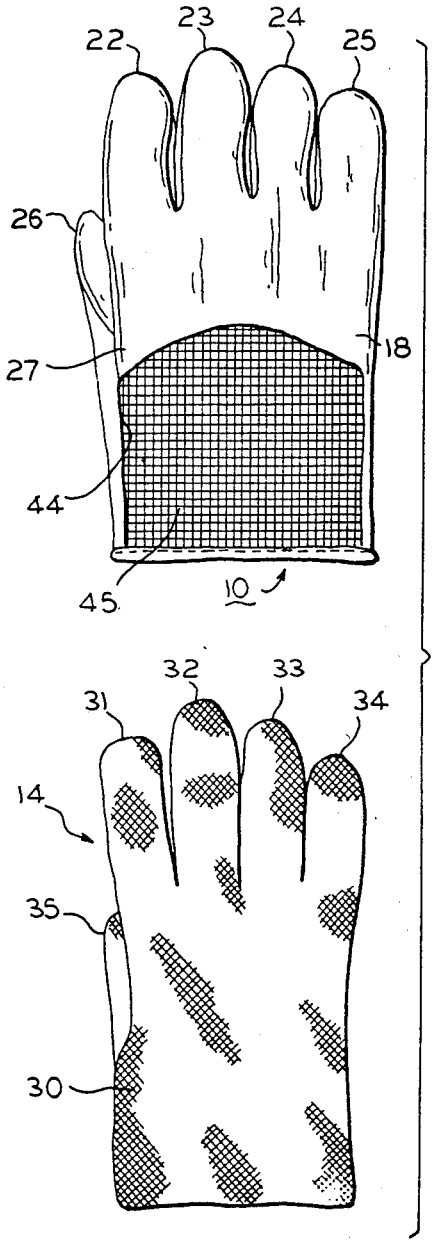
FIG. 2 is an exploded view showing the back of the work glove illustrated in FIG. 1.
Figure 3:
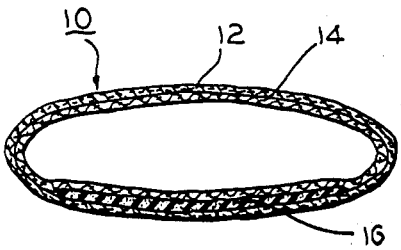
FIG. 3 is a cross-sectional view of the work glove shown in FIGS. 1 and 2.

The work glove 10 according to the invention is shown in FIGS. 1, 2 and 3 to include an outer shell of any suitable material, such as leather, pigskin or vinyl. Disposed within the shell 12 is a lining 14 preferably of a knit or woven material, such as cotton. Attached to the lining 14 is a pad 16 of a suitable impact resistant material. One such material found to be satisfactory in a high density cellular urethane sold under the trademark PORON 4701, and having a density of about 13–30 pounds per cubic foot.

The shell includes a back panel 18 and a front panel 20 which are sewn together to define a palm portion 21, finger portions 22, 23, 24 and 25, a thumb portion 26 and a back portion 27.

The lining 14 similarly has a front portion 29 and a back portion 30 which defines fingers 31, 32, 33 and 34 and a thumb 35. The pad 16 is formed with a palm portion 36, finger portions 37, 38, 39 and 40, and a thumb portion 41 and is affixed to the lining in any suitable manner, such as by sewing, with corresponding portions of the pad affixed to corresponding portions of the lining. As seen in FIGS. 1 and 3, the pad 16 may be stamped from a sheet material and in addition to the finger and thumb portion there are a plurality of spaced-apart apertures 42 extending therethrough as seen in FIG. 1, the apertures 42 are arranged in rows in the palm area of the pad which rows extend diagonally from the thumb side. Also, the finger portions 37, 38, 39 and 40 and the thumb portion 41 are each contoured such that they are of reduced width in the area of the joints 43 to facilitate bending of the operator's fingers. In addition, the back portion of the shell 12 may be cut out at 44 and a mesh 45 of any suitable material, such as nylon, may be substituted to facilitate ventilation.

Figure 4:
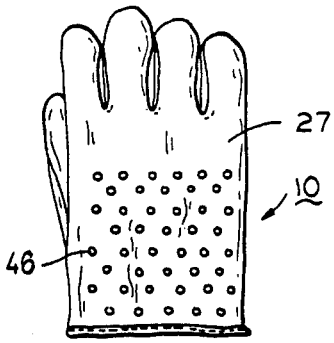
FIG. 4 shows an alternate embodiment of the invention.

In one alternate embodiment of the invention shown in FIG. 4, the ventilation in the back panel 27 is provided by a plurality of perforations 46.

In the embodiment of the invention shown in FIGS. 5 and 6, only a partial glove lining is employed. The glove 50 includes a pad 16 which is identical to pad 16 of FIGS. 1–4. Instead of a full lining, however, a pad 51 is attached to the rear of the pad 16 in any suitable manner such as by stitching 52. As seen in FIG. 5, the pad 51 is configured substantially the same as the pad 16 and is slightly larger. In particular, the pad 51 has a thumb portion 35' and finger portions 31', 32', 33' and 34'. While the pad 51 may be formed of any suitable material, one satisfactory material is a felt which may have a front facing of a knit cotton material. As shown in FIG. 6, the felt backing 51 covers an area slightly larger than the pad 16 with the remaining portion of the shell being unlined.

The embodiment of FIG. 7 is substantially the same as that of FIGS. 5 and 6 except that the finger and thumb portions of the shell 54, the pad 16' and the felt backing 51' are truncated. As the result, the user's fingers and thumb will extend from the ends of the finger and thumb portions to facilitate grasping small objects. As a further alternate embodiment of the invention, the thumb 26' of the embodiment of FIG. 7 may be full while each of the fingers are truncated.

The work glove according to the invention, substantially reduces shocks and vibrations which would otherwise be experienced by operators of such machinery as air hammers, chain saws and the like.

Those skilled in the art will appreciate that while only a few embodiments of the invention have been illustrated and described, it is not intended to be limited thereby, but only by the scope of the appended claims.

I claim:

1. A work glove comprising an outer shell including portions defining a palm, a back and finger and thumb portions, a lining disposed within said shell and having palm, finger, and thumb portions disposed adjacent the corresponding portions of said shell, and a foam pad disposed between said lining and said shell and encompassing a substantial portion of the palm and the frontal areas of the thumb and finger portions of the shell, said pad being relatively flat and having a plurality of perforations formed therein, the finger and thumb portions or said pad having areas of reduced width corresponding to the finger and thumb joints of a potential wearer thereof, said perforations being arranged in rows which extend diagonally and downwardly across the palm and from the side thereof containing the thumb.

2. The glove set forth in claim 1 wherein said pad is attached to said lining which in turn is affixed within said shell.

3. The glove set forth in claim 1 wherein said shell is formed of a material taken from the group consisting of leather, pigskin and vinyl and said lining is composed of a knitted fabric material.

4. The glove set forth in claim 1 wherein the back of said shell is air permeable for purposes of ventilation.

5. The glove set forth in claim 4 wherein a portion of the back of said shell is cut out and a mesh material disposed therein.

6. The glove set forth in claim 4 wherein a plurality of apertures are formed in the back of said shell.

7. The glove set forth in claim 1 wherein said pad is formed of a high density cellular urethane material.

8. The work glove set forth in claim 7 wherein said shell is formed of a material taken from the group consisting of leather, pigskin and vinyl and said lining is composed of a felt material having an area slightly larger than the foam pad.

9. The glove set forth in claim 8 wherein the finger and thumb portions of said shell are truncated and open-ended.

10. The glove set forth in claim 8 wherein said pad is attached to said lining which in turn is affixed within said shell.

11. The work glove set forth in claim 7 wherein said shell is formed of a material taken from the group consisting of leather, pigskin and vinyl and said lining is composed of a knitted fabric material.

12. The glove set forth in claim 11 wherein the finger and thumb portions of said shell are truncated and open-ended.

13. The glove set forth in claim 11 wherein the back of said shell is air permeable for purposes of ventilation.

14. The glove set forth in claim 13 wherein a portion of the back of said shell is cut out and a mesh material disposed therein.

15. The glove set forth in claim 13 wherein a plurality of apertures are formed in the back of said shell.

* * * * *